US008147123B2

(12) United States Patent
Huckby

(10) Patent No.: US 8,147,123 B2
(45) Date of Patent: Apr. 3, 2012

(54) APPARATUS WITH AUTOMATIC BALANCING FOR MIXING PAINT DISPOSED IN CONTAINERS HAVING DIFFERENT CONFIGURATIONS

(75) Inventor: Dwight R. Huckby, Brookpark, OH (US)

(73) Assignee: The Sherwin-Williams Company, Cleveland, OH (US)

( * ) Notice: Subject to any disclaimer, the term of this patent is extended or adjusted under 35 U.S.C. 154(b) by 0 days.

(21) Appl. No.: 12/732,280

(22) Filed: Mar. 26, 2010

(65) Prior Publication Data

US 2010/0177592 A1 Jul. 15, 2010

Related U.S. Application Data

(62) Division of application No. 11/245,855, filed on Oct. 7, 2005, now Pat. No. 7,686,502.

(60) Provisional application No. 60/617,291, filed on Oct. 8, 2004.

(51) Int. Cl.
*B01F 9/10* (2006.01)

(52) U.S. Cl. ..... 366/217; 366/605

(58) Field of Classification Search ..... 366/213, 366/214, 217, 605
See application file for complete search history.

(56) References Cited

U.S. PATENT DOCUMENTS

| | | | | | |
|---|---|---|---|---|---|
| 449,665 | A * | 4/1891 | Camp | ..... | 366/214 |
| 755,216 | A * | 3/1904 | Carrier | ..... | 366/214 |
| 2,006,451 | A * | 7/1935 | Glidden | ..... | 366/213 |
| 2,423,969 | A * | 7/1947 | Foltz | ..... | 366/224 |
| 3,542,344 | A * | 11/1970 | Oberhauser | ..... | 366/202 |
| 4,235,553 | A * | 11/1980 | Gall | ..... | 366/208 |
| 4,497,581 | A * | 2/1985 | Miller | ..... | 366/208 |
| 6,530,500 | B2 * | 3/2003 | Bravo et al. | ..... | 222/143 |
| 2003/0107949 | A1 * | 6/2003 | Huckby et al. | ..... | 366/217 |
| 2003/0142583 | A1 * | 7/2003 | Santospago et al. | ..... | 366/209 |
| 2004/0085855 | A1 * | 5/2004 | Midas et al. | ..... | 366/209 |
| 2004/0141412 | A1 * | 7/2004 | Midas et al. | ..... | 366/217 |

* cited by examiner

*Primary Examiner* — David Sorkin
(74) *Attorney, Agent, or Firm* — Arthi K. Tirey; Robert E. McDonald; Vivien Y. Tsang

(57) ABSTRACT

An apparatus and method are provided for mixing paint disposed in either a conventional one gallon paint container or a square paint container having a body with a handle passage extending therethrough. The apparatus includes a square bucket for holding the container. A rocker is pivotably mounted to a side wall of the bucket and includes a pair of heads aligned over a pair of openings in the side wall. A floor of the bucket has a plurality of support structures extending upwardly therefrom. When the conventional one gallon paint container is disposed in the bucket, the container rests on the floor, the vertical axis of the container is offset from the central axis of the bucket, and both heads of the rocker are disposed against the container inside the bucket. When the square paint container is disposed in the bucket, the container is supported on top of the support structures so as to be elevated above the floor, the vertical axis of the container is collinear with the central axis of the bucket, and one of the heads of the rocker is disposed in the handle passage of the container.

4 Claims, 9 Drawing Sheets

APPARATUS WITH AUTOMATIC BALANCING FOR MIXING PAINT DISPOSED IN CONTAINERS HAVING DIFFERENT CONFIGURATIONS

CROSS-REFERENCE TO RELATED APPLICATIONS

This application is a divisional of U.S. application Ser. No. 11/245,855, filed Oct. 7, 2005, which claims the benefit of U.S. Provisional Application No. 60/617,291, filed Oct. 8, 2004, the entirety of each of which is hereby incorporated by reference.

The present invention relates to the mixing of fluid dispersions and more specifically to apparatus and methods for mixing paint disposed in a container having either a cylindrical or a square shape.

As is well known, solids in fluid dispersions, such as paint, tend to settle in a downward direction through the force of gravity. Fluid dispersions disposed in containers for commercial sale are typically mixed in the containers before they are used by the purchasers. Many fluid dispersions can be facilely mixed in a container by manually shaking the container. Other fluid dispersions, however, such as paint, are more difficult to manually mix in a container and, thus, are often mixed in the container using a machine that shakes, rotates, vibrates or otherwise moves the container.

A variety of different types of mixing machines are known for mixing fluid dispersions disposed in containers. One type of mixing machine that is commonly used to shake individual containers is known as a vortex mixer. In a vortex mixer, the container containing the dispersion is rotated around at least one axis. Typically, the container is at least rotated about its own vertical axis. Examples of conventional vortex mixers include those disclosed in U.S. Pat. No. 3,542,344 to Oberhauser, U.S. Pat. No. 4,235,553 to Gall, and U.S. Pat. No. 4,497,581 to Miller, all of which are hereby incorporated by reference. Conventional vortex mixers such as these can only accommodate cylindrical containers. Such vortex mixers cannot properly accommodate generally square or rectangular containers. Paint, however, is beginning to be packaged in generally square or rectangular containers. Moreover, some of these containers have integral handles formed in their bodies. A commercial example of a generally square container with an integral handle molded in the body thereof is the TWIST & POUR™ container sold by The Sherwin-Williams Company, who is the assignee of the present application. Another example of such a container is disclosed in U.S. Pat. No. 6,530,500 to Bravo et al., which is assigned to The Sherwin-Williams Company.

An integral handle formed in a body of a container changes the weight distribution of the paint disposed in the container, which causes one side of the container (with reference to the vertical axis of the container) to be heavier than the other. As a result, when the container is rotated in a vortex mixer, the vortex mixer may become unbalanced, thereby causing the vortex mixer to rock or shake excessively. One known solution to this problem is to balance the weight of the container (with respect to the vertical axis of the container) by inserting a counterweight into the integral handle of the container. This solution, however, requires a separate device (the weight) and the performance of an additional step in the mixing process (placing the weight in the handle insert).

Another known method for providing balanced mixing of a container with an integral handle is to offset the vertical axis of the container from the axis of rotation of the bucket that holds the container during mixing. If the container is square and the handle is located at a corner, the axis of the container is offset by increasing the radius of curvature of one of the corners of the bucket. An example of such a bucket is sold by Ultrablend Systems Inc. and is disclosed in published U.S. Patent Application No. 2003/0142583A1. This bucket requires the container to be properly positioned in the bucket such that the handle of the container is positioned at a corner diametrically opposite to the corner with the increased radius of curvature. A visual notice is provided, indicating the proper positioning of the container in the bucket, however nothing prevents the container from being improperly positioned in the bucket. As can be appreciated, the foregoing bucket is susceptible to improper positioning of the container in the bucket.

A bucket developed by Red Devil Inc. addresses the foregoing positioning problem by including a pair of rocker arms mounted at the corner of the bucket where the handle of the container is to be placed. The rocker arms ensure the proper positioning of the container in the bucket.

The present invention is directed to a device for mixing paint disposed in a generally square container with an integral handle (as well as a conventional cylindrical container), wherein the device has an automatic balancing feature that does not require the use of a container counterweight and is not susceptible to improper positioning of the container. In accordance with the present invention, the device includes a bucket for holding the container and an electric motor for rotating the bucket. The bucket has a central axis and includes a retainer having a plurality of side walls joined together at rounded corners so as to define an interior holding space with a substantially square cross-section. The bucket further includes a base secured to the bottom of the retainer. The base has a floor with a plurality of support structures extending upwardly therefrom. The support structures at least partially define the periphery of a cylinder-receiving region of the floor that has a center that is offset from the central axis of the bucket in the direction of one of the corners of the retainer. When the container is cylindrical and is disposed in the bucket, a bottom end of the container is supported on the cylinder-receiving region of the floor and is disposed inwardly of the support structures, and the vertical axis of the container is offset from the central axis of the bucket in the direction of one of the corners of the retainer. When the container has a substantially square cross-section, the container is supported on top of the support structures so as to be elevated above the floor, and the vertical axis of the container is collinear with the central axis of the bucket.

In accordance with another feature of the present invention, a side wall of the bucket has a pair of openings formed therein. A rocker having a body joined between a pair of heads is pivotally connected to the side wall and is movable between first, second, and third positions. When the container is disposed in the bucket and the container is a conventional one gallon paint container, the rocker is in the third position and the heads of the rocker extend through the openings and are disposed against the container. When the container is disposed in the bucket and the container has a handle passage and a substantially square cross-section, the rocker is in the first position and one of the heads of the rocker extends through one of the openings and into the handle passage of the container.

Also provided in accordance with the present invention, is a method of mixing paint. In accordance with the method, a cylindrical container filled with a first paint is provided. The cylindrical container is disposed between at least one pair of opposing walls. The at least one pair of opposing walls and the cylindrical container are rotated about an axis that is parallel to and spaced from the vertical axis of the cylindrical container. The cylindrical container is then removed from between the at least one pair of opposing walls.

BRIEF DESCRIPTION OF THE DRAWINGS

The features, aspects, and advantages of the present invention will become better understood with regard to the following description, appended claims, and accompanying drawings where:

DETAILED DESCRIPTION OF THE PREFERRED EMBODIMENTS

Figure 1:
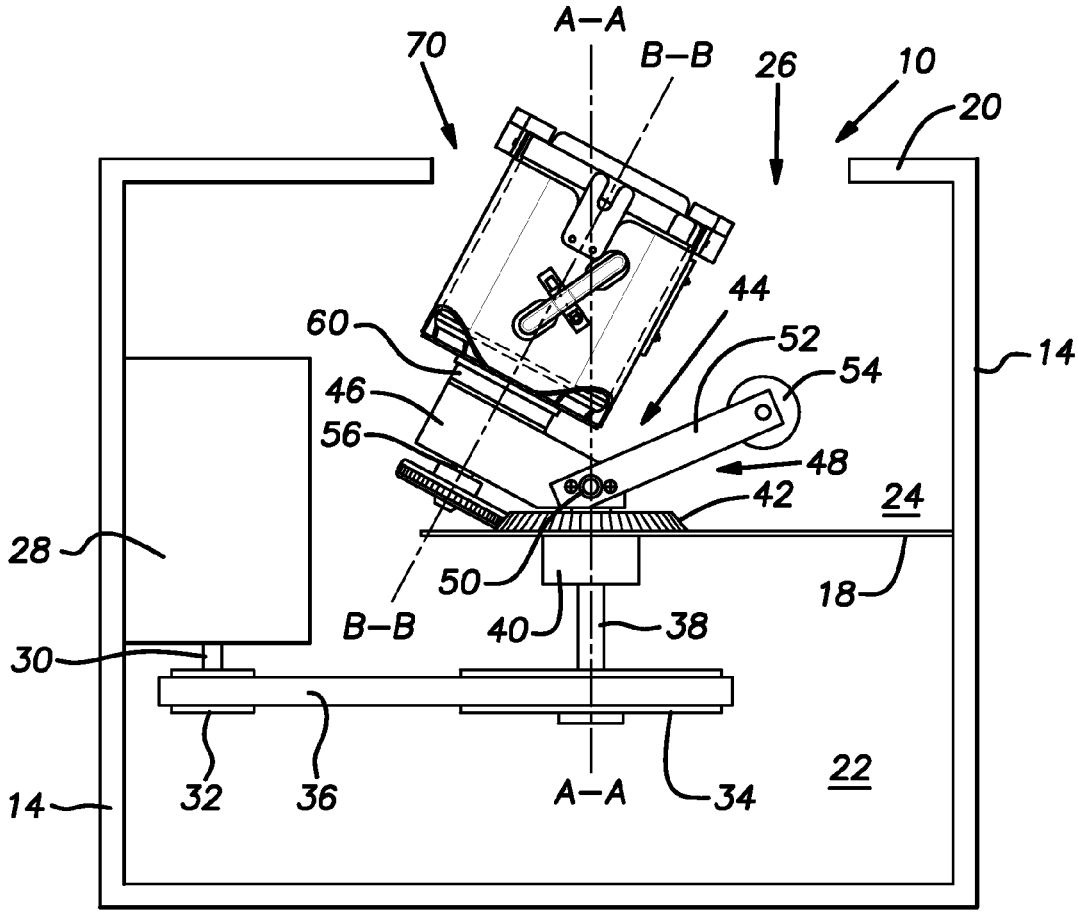
FIG. 1 shows a side view of a mixing apparatus having a cabinet with a portion cut away to better show the interior thereof.

It should be noted that in the detailed description that follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

As used herein, the term "conventional one gallon paint container" shall mean a cylindrical metal container for holding paint, having a diameter of about $6\frac{10}{16}$ inches, a height of about $7\frac{11}{16}$ inches, an interior volume of slightly greater than 1 U.S. gallon, and including a bail handle secured to a pair of mounting ears, each with a diameter of about ¾ of an inch.

Referring now to FIG. 1, there is shown a mixing apparatus 10 embodied in accordance with the present invention. The mixing apparatus 10 is operable to mix a fluid dispersion, such as paint, that is disposed in either a cylindrical container or in a generally square container. For proper operation, the mixing apparatus 10 should be disposed on a substantially horizontal surface, and in the following description, it will be assumed that the mixing apparatus 10 is so disposed.

The mixing apparatus 10 includes a rectangular cabinet having upstanding side walls 14, a bottom wall 16, an access door (not shown), an intermediate wall 18 and an upper wall 20. The intermediate wall 18 divides the cabinet into a lower drive chamber 22 and an upper loading chamber 24. The access door closes an opening (not shown) that provides access to the drive chamber 22. The access door may be hinged to one of the adjacent side walls 14 so as to be pivotable between open and closed positions, or the access door may be removably disposed between the ends of two of the side walls 14. The upper wall 20 has an enlarged circular opening 26 formed therein, which provides access to the loading chamber 24. Although not shown, a hood may mounted to the cabinet, above the upper wall 20.

An electric motor 28 is mounted toward the rear of the cabinet and extends between the drive chamber 22 and the loading chamber 24. A rotor shaft 30 of the electric motor 28 extends downwardly and is disposed in the drive chamber 22. A motor sprocket 32 with teeth is secured to an end of the rotor shaft 30. The motor sprocket 32 is drivingly connected to a larger diameter drive sprocket 34 by an endless belt 36 having interior ribs. The drive sprocket 34 is secured to a lower end of a vertical drive shaft 38 that extends upwardly through a bearing mount 40 and into the loading chamber 24 through an opening (not shown) in the intermediate wall 18. In the loading chamber 24, the drive shaft 38 extends through a central passage (not shown) in a pedestal 42 that is disposed on an upper side of the intermediate wall 18. An upper end of the drive shaft 38 is secured to a yoke 44 disposed in the loading chamber 24, above the pedestal 42. The bearing mount 40 is secured to the pedestal 42, with the intermediate wall 18 trapped in between. The bearing mount 40 has a plurality of bearings (not shown) disposed therein for rotatably supporting the drive shaft 38.

Figure 2:
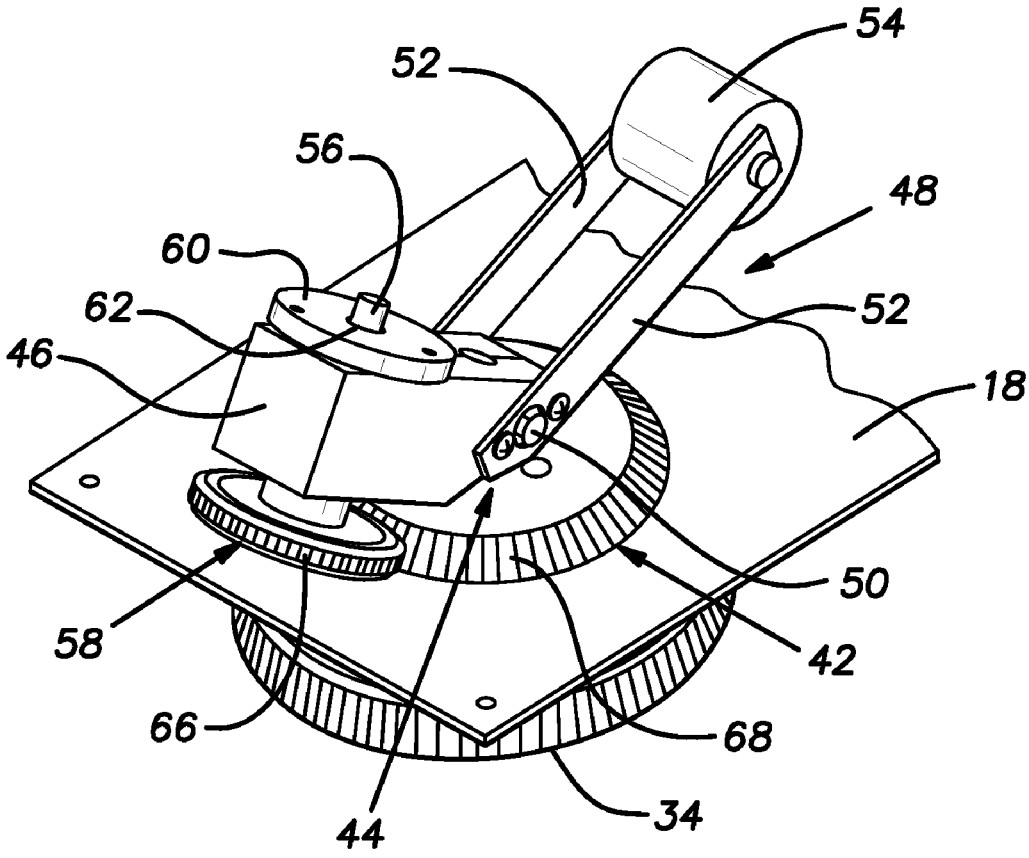
FIG. 2 shows a top perspective view of a portion of the mixing apparatus.

Referring now also to FIG. 2, the yoke 44 includes a mounting arm 46 and a balancing arm 48 secured together at their inner ends by a bolt 50 that also secures the upper end of the drive shaft 38 to the yoke 44. The mounting arm 46 and the balancing arm 48 extend outwardly in opposing lateral directions and extend upwardly at acute angles from the vertical. The balancing arm 48 is bifurcated and includes a pair of spaced-apart elongated plates 52. A cylindrical counterweight 54 is secured between outer ends of the plates 52. The counterweight 54 balances the yoke 44 when a container of a fluid dispersion, such as paint, is mounted to the mounting arm 46, as will be described more fully below.

A mounting shaft 56 rotatably extends through a passage (not shown) in the mounting arm 46. Bearings (not shown) may be disposed in the passage to reduce friction between the mounting shaft 56 and the mounting arm 46. A drive wheel 58 is secured to a bottom portion of the mounting shaft 56, below the mounting arm 46, while a mounting support 60 is secured to an upper portion of the mounting shaft 56, above the mounting arm 46. The mounting support 60 may circular (as shown) or square. The mounting support 60 includes a center passage 62 through which an upper end of the mounting shaft 56 extends. A plurality of threaded bores 64 are formed in the mounting support 60 and are disposed around the center passage 62.

The drive wheel 58 has a side surface with gear teeth 66 formed therein which are in mechanical engagement with mating gear teeth 68 formed in a side surface on the pedestal 42. When the yoke 44 rotates about an axis A-A (shown in FIG. 1) extending through the drive shaft 38 (as will be described more fully below), the drive wheel 58 is moved around the pedestal 42. Since the gear teeth 66 in the side surface of the drive wheel 58 are in engagement with the gear teeth 68 in the side surface on the pedestal 42, the drive wheel 58 rotates around an axis B-B (shown in FIG. 1) extending through the mounting shaft 56 (as will be further described below). The axis B-B extends upwardly and preferably intersects the axis A-A at an acute angle of from about 20° to about 40°, more preferably at an angle of about 30°. If the mixing apparatus 10 is disposed on a substantially horizontal surface, the axis A-A extends substantially vertical, i.e., at about 90° from the horizontal.

It should be appreciated that in lieu of the drive wheel 58 and the pedestal 42 being in positive mechanical engagement, the drive wheel 58 and the pedestal 42 may be in frictional engagement through the use of friction surfaces on the drive wheel 58 and the pedestal 42.

For reasons that will be explained more fully below, the polarity of the electric motor 28 is set so as to rotate the yoke 44 about the axis A-A in a counter-clockwise direction, which causes the mounting support 60 to rotate about the axis B-B in a counter-clockwise direction.

It should be appreciated that the present invention is not limited to the particular mechanical arrangement described above for rotating the mounting support 60 about a plurality of axes. Other known mechanical arrangements may be utilized for rotating the mounting support 60 about a plurality of axes.

Figure 3:
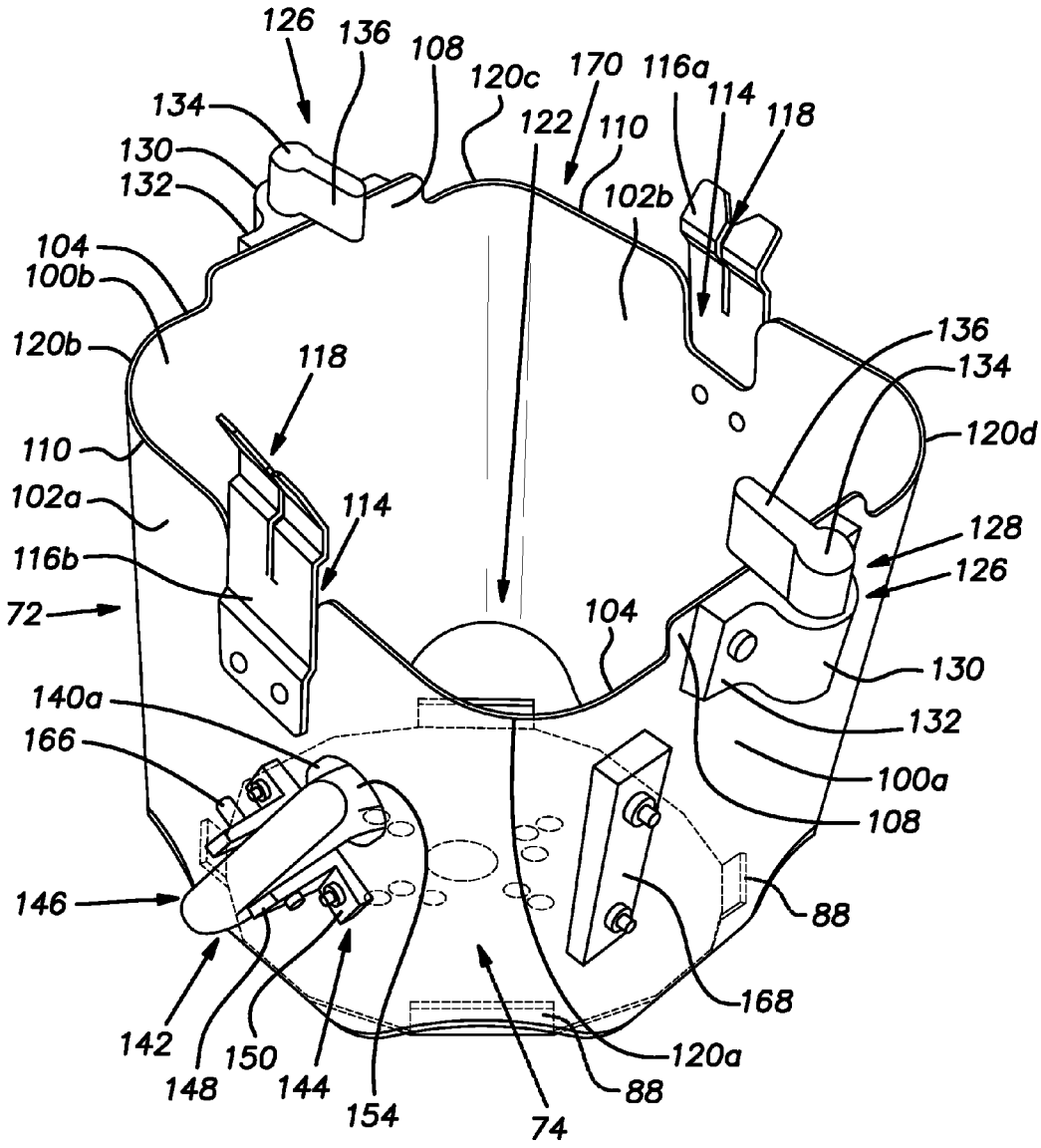
FIG. 3 shows a top perspective view of a bucket of the mixing apparatus.
Figure 4:
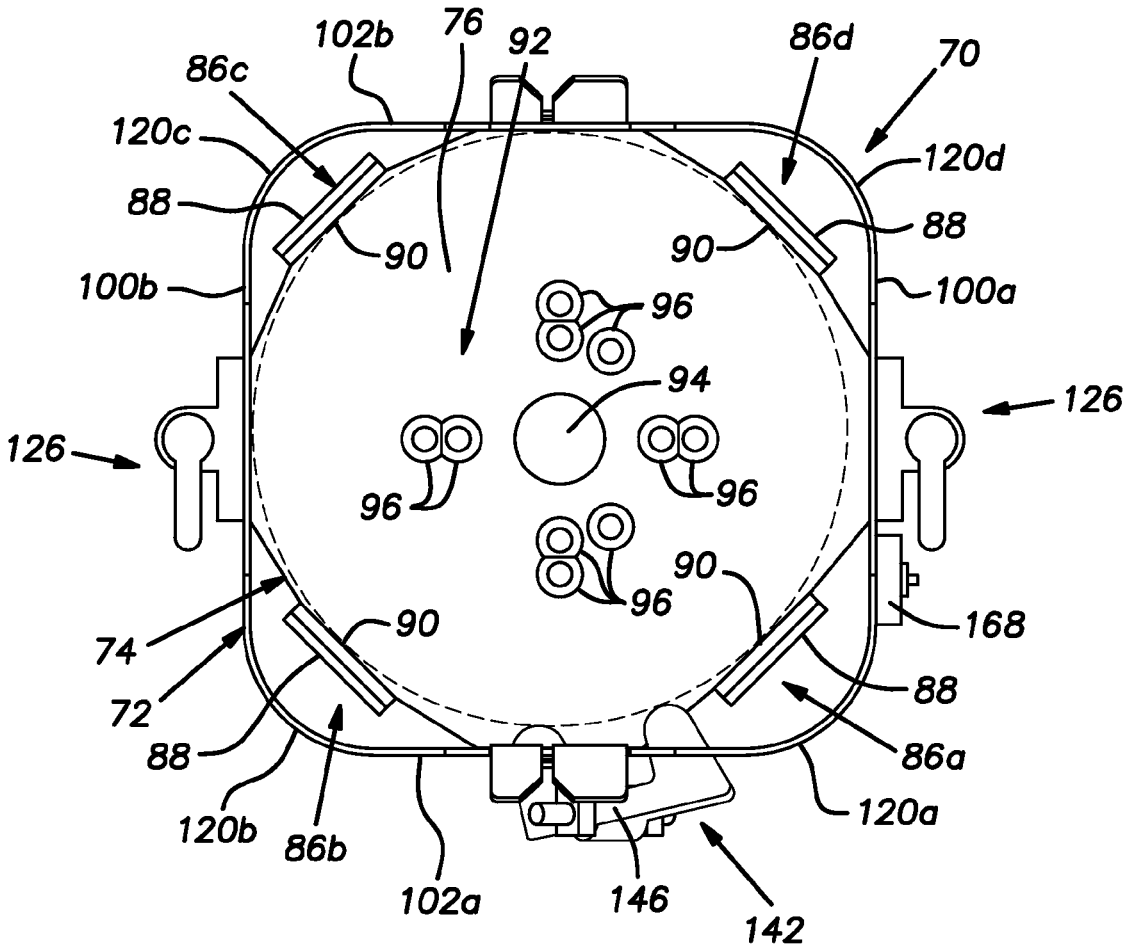
FIG. 4 shows a top view of the bucket.

Referring now to FIGS. 3 and 4, there are shown a perspective top view and a top plan view of a bucket 70 for holding a container of a fluid dispersion, such as paint. The bucket 70 includes a retaining structure 72 joined to a base 74.

Figure 5:
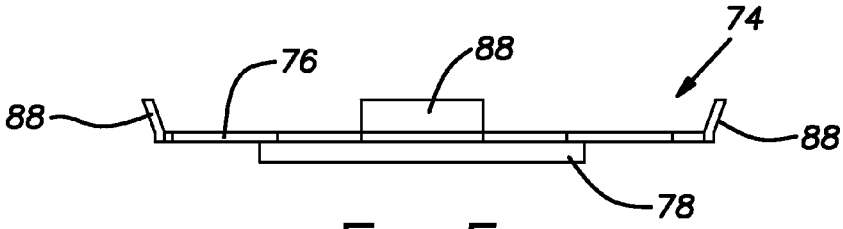
FIG. 5 shows a side view of a base of the bucket.
Figure 6:
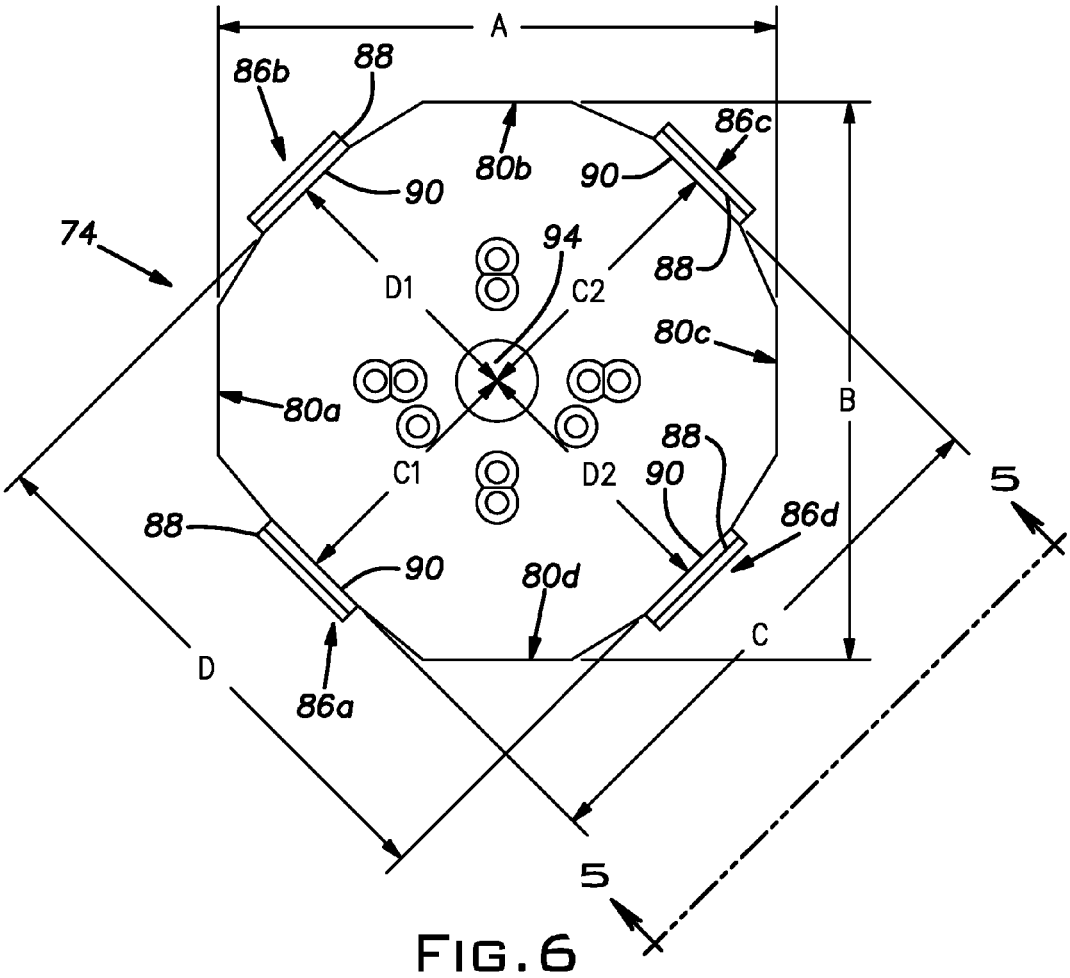
FIG. 6 shows a top view of the base, displaying certain dimensions.

Referring now also to FIGS. 5 and 6, the base 74 is composed of metal and includes a floor plate 76 with a mount 78 (shown in FIG. 5) located on a bottom side thereof. The mount 78 may be a separate structure joined by welding or other means to a bottom surface of the floor plate 76 (as shown), or the mount 78 may be integral with the floor plate 76 and merely comprise an indented central portion of the floor plate 76. The floor plate 76 has an outer periphery defined by connection regions 80*a,b,c,d* disposed between flanged regions 86*a,b,c,d*. Each of the connection regions 80*a,b,c,d* comprises a straight edge, while the flanged regions 86*a,b,c,d* each comprise two minor edges extending at angles from opposing ends of a major center edge. In the flanged region 86*a*, the minor edges are disposed at very small angles, thereby almost forming a single straight edge. Since there are four connection regions 80*a,b,c,d* and four flanged regions 86*a,b,c,d*, the floor plate 76 has a generally octagonal shape. A rectangular tab or flange 88 extends upwardly and outwardly from each of the flanged regions 86*a,b,c,d*. With regard to the flanged regions 86*a,b,c,d*, the flanges 88 extend upwardly and outwardly from the major center edge. The flanges 88 are preferably integrally formed with the rest of the floor plate 76 and are bent upwardly at bends 90. The bends 90 help define the periphery of a cylinder receiving region 92 of the floor plate 76.

An axial opening 94 is positioned in the center of the floor plate 76 and extends through the base 74. A plurality of mounting bores 96 are disposed around the axial opening 94 and extend through the base 74 as well. The mounting bores 96 are preferably arranged in groups located in four recessed areas that form the corners of a square pattern. One of the mounting bores 96 in each group can be aligned with one of the threaded bores 64 in the mounting support 60. A plurality of the mounting bores 96 are provided in each of the recessed areas to permit the mounting bores to be aligned with threaded bores in mounting supports of different types of mixing machines, wherein the threaded bores are arranged in different patterns.

FIG. 6 shows a top view of the base with certain dimensions indicated by letters. The dimension A represents the distance between the edges in opposing connection regions 80*a,c*, while the dimension B represents the distance between the edges in opposing connection regions 80*b,d*. The dimension C represents the distance between the bend 90 of the flange 88 in the flanged region 86*a* and the bend 90 of the flange 88 in the flanged region 86*c*, while the dimension D represents the distance between the bend 90 of the flange 88 in the flanged region 86*b* and the bend 90 of the flange 88 in the flanged region 86*d*. The dimension C1 represents the distance between the bend 90 of the flange 88 in the flanged region 86*a* and the center of the axial opening 94, while the dimension C2 represents the distance between the bend 90 of the flange 88 in the flanged region 86*c* and the center of the axial opening 94. The dimension D1 represents the distance between the bend 90 of the flange 88 in the flanged region 86*b* and the center of the axial opening 94, while the dimension D2 represents the distance between the bend 90 of the flange 88 in the flanged region 86*d* and the center of the axial opening 94. The dimensions A and B are the same, and the dimensions C and D are the same. The dimensions A, B are greater than the dimensions C, D. The dimension C2 is greater than the dimension C1, whereas the dimensions D1 and D2 are the same.

In a first embodiment of the present invention, the distances A, B are each 6.865 inches, the distances C, D are each 6.64 inches, the distance C2 is 3.470 inches, the distance C1 is 3.170 inches, and distances D1, D2 are each 3.320 inches.

Since the dimension C2 is greater than the dimension C1, the axial opening 94 is not located in the center of the cylinder receiving region 92 of the floor plate 76, or, to put it another way, the cylinder receiving region 92 is not centered on the floor plate 76. Rather the cylinder receiving region 92 is offset toward the flanged region 86*c*. As a result, when a conventional one gallon paint container is disposed in the cylinder receiving region 92 of the floor plate 76, the vertical axis of the paint container is offset from the axis of rotation B-B in the direction of the flanged region 86*c*. Thus, the center of mass of the paint container and the paint disposed therein is offset from the axis of rotation B-B, toward the flanged region 86*c*.

The retaining structure 72 is comprised of a pair of parallel and substantially planar first walls 100*a,b* and a pair of parallel and substantially planar second walls 102*a,b*. Each of the first walls 100*a,b* is generally rectangular and includes a horizontal top edge 104 and a beveled bottom edge 106 extending between vertical side portions. Each bottom edge 106 includes a horizontal center portion disposed between upwardly-sloping side portions. A generally rectangular flange 108 extends upwardly from a center portion of each top edge 104. Each of the second walls 102*a,b* is also generally rectangular and includes a horizontal top edge 110 and a beveled bottom edge 112 extending between vertical side portions. Each bottom edge 112 includes a horizontal center portion disposed between upwardly-sloping side portions. A generally rectangular slot 114 is formed in each of the second walls 102*a,b* and extends downwardly from the top edge 110. Spring clips 116*a,b* with downwardly-extending openings 118 are secured to the second walls 102*a,b* and are disposed over the slots 114. The spring clip 116*b* includes a middle portion that bends inwardly so as to be disposed within or interior of the slot 114 in the second wall 102*a*, whereas the spring clip 116*a* has a middle portion that bends outwardly so as to be spaced outwardly from the slot 114 in the second wall 102*b*. The spring clips 116*a,b* are operable to hold mounting ears and a bail handle of a conventional one gallon paint container.

The first and second walls 100*a,b*, 102*a,b* are arranged to provide the retaining structure 72 with a substantially square cross-section. Preferably, the side edges of the first walls 100*a,b* are joined to side edges of the second walls 102*a,b* at curved or rounded corners 120*a,b,c,d* (best shown in FIGS. 4 and 5). In this manner, the retaining structure 72 defines an inner void or holding space 122 having a cross section that is square with rounded corners. The beveled bottom edges 106, 112 of the first and second walls 100*a,b*, 102*a,b* permit the bucket 70 to freely rotate about the axis B-B without hitting the mounting arm 46 of the yoke 44.

The floor plate 76 of the base 74 is secured to the retaining structure 72. More specifically, the center portions of the bottom edges 106 of the first walls 100*a,b* are secured to the edges of the connection regions 80*a,c* by welding or other means, while the center portions of the bottom edges 112 of the second walls 102*a,b* are secured to the edges of the connection regions 80*b,d* by welding or other means. With the base 74 secured to the retaining structure 72 in this manner, the corner 120*a* is aligned with the flanged region 86*a*.

In the first embodiment of the present invention, the interior distance between the first walls 100*a,b* and the interior distance between the second walls 102*a,b* are each about 6.865 inches. The corners 120*a,b,c,d*, however, are formed so as to reduce the distance between the centers of adjacent corners 120*a,b,c,d* to about 6.625 inches. In this regard, the corners 120*a,b,c,d* each have a radius of curvature of about 1.375 inches. As a result of the configuration of the corners 120*a,b,c,d*, the retaining structure 72 can snugly accommodate a square container having a width of about 6.625 inches, which corresponds to the width of a conventional one gallon paint container. In so accommodating such a square container, the retaining structure 72 only contacts the square container at the corners 120*a,b,c,d*, as will be further discussed below.

Since the cylinder receiving region 92 is not centered on the floor plate 76 and is offset towards the flange region 86*c*, the cylinder receiving region 92 is offset toward the second wall 102*b*. As a result, when a conventional one gallon paint container is disposed in the bucket 70, the container is spaced by a gap 124 (shown in FIG. 11) from the second wall 102*a*, as will be discussed further below.

A pair of clamp assemblies 126 are secured to the rectangular flanges 108 of the first walls 100*a,b*. Each clamp assembly 126 comprises a clamping structure 128 and a casing 130 with an interior bore joined to a mounting plate 132. The mounting plates 132 are secured to the rectangular flanges 108 by press fit pins or other means. Each clamping structure 128 includes a head 134 secured to a top end of a rod (not shown). The rods are slidably disposed in the bores of the casings 130. In this manner, the clamping structures 128 are vertically movable between a contracted position, wherein the head 134 abuts the casing 130, and an extended position, wherein the head 134 is spaced above the casing 130. Bottom portions of the rods are secured to springs that are attached to the casings 130 and bias the clamping structures 128 toward their contracted positions. The heads 134 of the clamping structures 128 are provided with levers 136 for engaging a container disposed in the bucket 70. The levers 136 also function as handles that may be grasped by an operator when the clamping structures 128 are being manipulated by the operator. In this regard, the clamping structures 128 are rotatable between a clamping position, (shown in FIGS. 9-11), wherein the levers 136 extend inwardly over the base 74 so as to be perpendicular to the first walls 100*a,b*, and a released position (shown in FIG. 4), wherein the levers 136 extend parallel to the first walls 100*a,b*.

Figure 7:
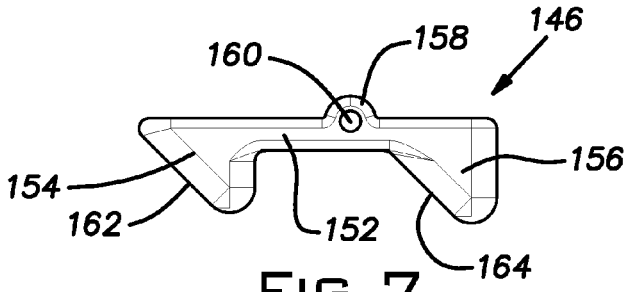
FIG. 7 shows a top view of a rocker of the bucket.
Figure 9:
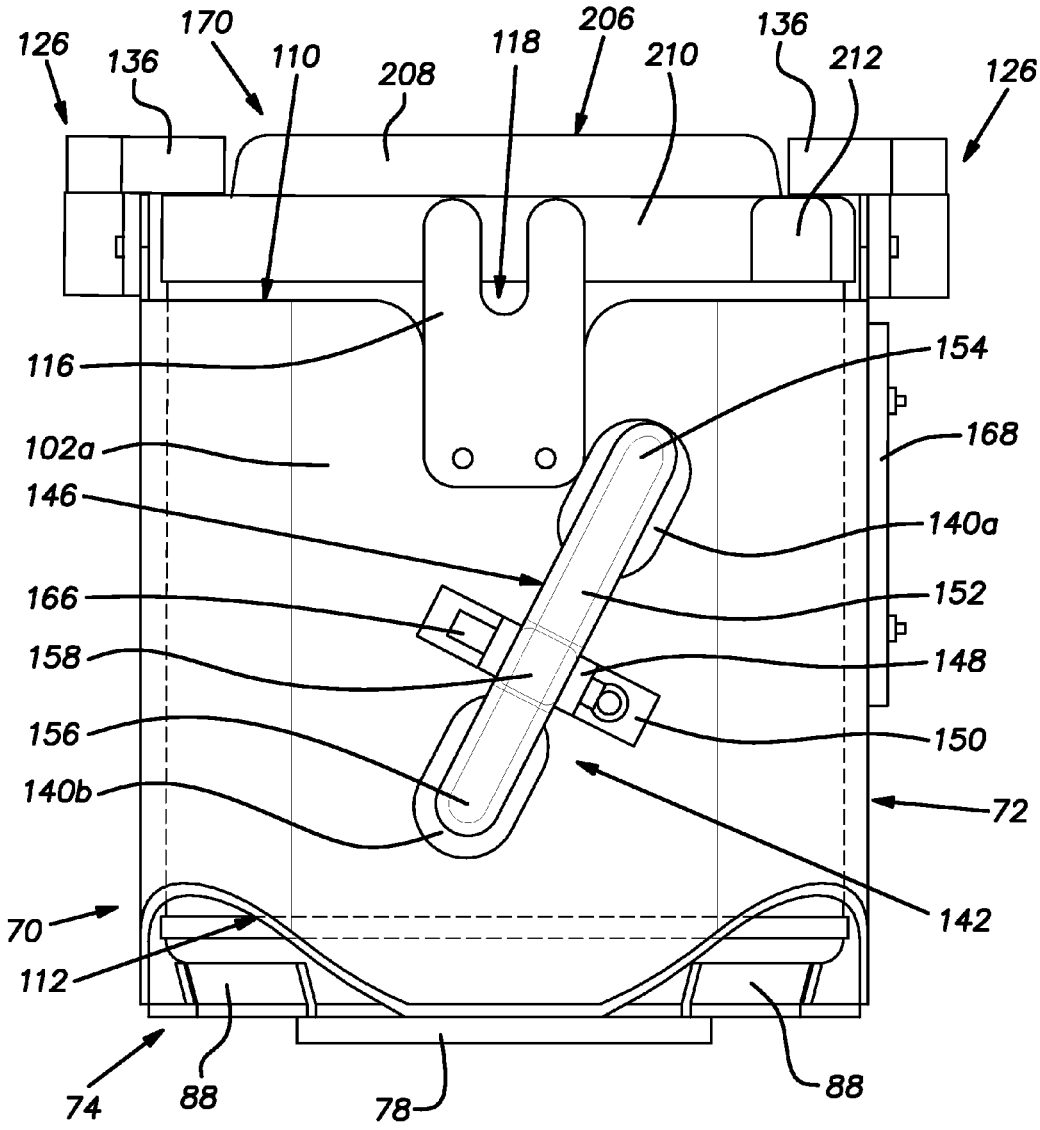
FIG. 9 shows a side elevational view of the generally square paint container disposed in the bucket of the mixing apparatus.

With reference to FIGS. 3, 7 and 9, a pair of elliptical openings 140*a,b* are formed in the second wall 102*a*. The opening 140*b* is disposed toward the lateral center of the second wall 102*a* and toward the bottom edge 112 of the second wall 102*a*, whereas the opening 140*a* is disposed toward the corner 120*a* and toward the top edge 110 of the second wall 102*a*. In this manner, the openings 140*a,b* are arranged in a downwardly extending angle in the direction of the first walls 100*a,b*. A holding guide 142 is secured to an exterior surface of the second wall 102*a*. The holding guide 142 includes a yoke 144 and a rocker 146. The yoke 144 comprises a pair of spaced-apart holding arms 148 extending outwardly from an attachment plate 150. Openings are formed in outer end portions of the arms 148. The rocker 146 includes an elongated body 152 joined between enlarged first and second heads 154, 156. The body 152 includes interior and exterior sides. An arcuate pivot mount 158 protrudes outwardly from the exterior side of the body 152 and has a passage 160 extending therethrough. The pivot mount 158 is disposed toward the second head 156. The first head 154 has a sloping outer surface 162, while the second head 156 has a sloping inner surface 164. The rocker 146 is disposed between the arms 148 of the yoke 144, with the first head 154 aligned with the opening 140*a*, the second head 156 aligned with the opening 140*b* and the passage 160 in the pivot mount 158 aligned with the openings in the arms 148. A pin 166 extends through the passage 160 and the openings, thereby pivotally mounting the rocker 146 to the yoke 144. The rocker 146 is movable between a first position and a second position. In the first position, the first head 154 extends through the opening 140*a* such that a major portion of the first head 154 is disposed in the holding space 122, whereas no portion or only a small portion of the second head 156 is disposed in the holding space 122. In the second position, the second head 156 extends through the opening 140*b* such that a major portion of the second head 156 is disposed in the holding space 122, whereas no portion or only a small portion of the first head 154 is disposed in the holding space 122. Between the first position and the second position, the rocker 146 may be oriented in a third position, wherein the first and second heads 154, 156 extend through the openings 140*a,b* such that substantial portions of both the first and second heads 154, 156 are disposed in the holding space 122. Since the pivot mount 158 is disposed toward the second head 156, the rocker 146 is normally disposed in the first position.

A weight bar 168 is secured to the first wall 100*a*, toward the corner 120*a*. The weight bar 168 is preferably solid and composed of a metal, such as steel. The weight bar 168 is secured to the first wall 100*a* by screws, bolts, or press fit pins that extend through aligned openings in the weight bar 168 and the first wall 100*a*. Alternately, the weight bar 168 may be secured to the first wall 100*a* by welding or other means. The weight bar 168 is positioned to extend longitudinally along the length of the corner 120*a*. The weight bar 168 and to a lesser extent the holding guide 142 comprise an added weight that increases the weight of the bucket 70 at the corner 120*a*, thereby shifting the center of mass of the bucket 70 toward the corner 120*a*. As will be discussed further below, the amount of the added weight is selected so as to be substantially equal to the weight of paint displaced by an integral handle in a corner of a square paint container.

The retaining structure 72 may be constructed from a single piece of sheet metal that is bent and joined together at a spot-welded seam (not shown), which is preferably located in one of the first walls 100*a,b*. The sheet metal may powder coated to enhance the appearance of the retaining structure 72 and to protect it from corrosion.

Although the bucket 70 is described above as being constructed from two separate metal structures, namely the retaining structure 72 and the base 74, it should be appreciated that the bucket 70 could be a unitary structure composed of plastic, such as high density polyethylene.

Figure 8:
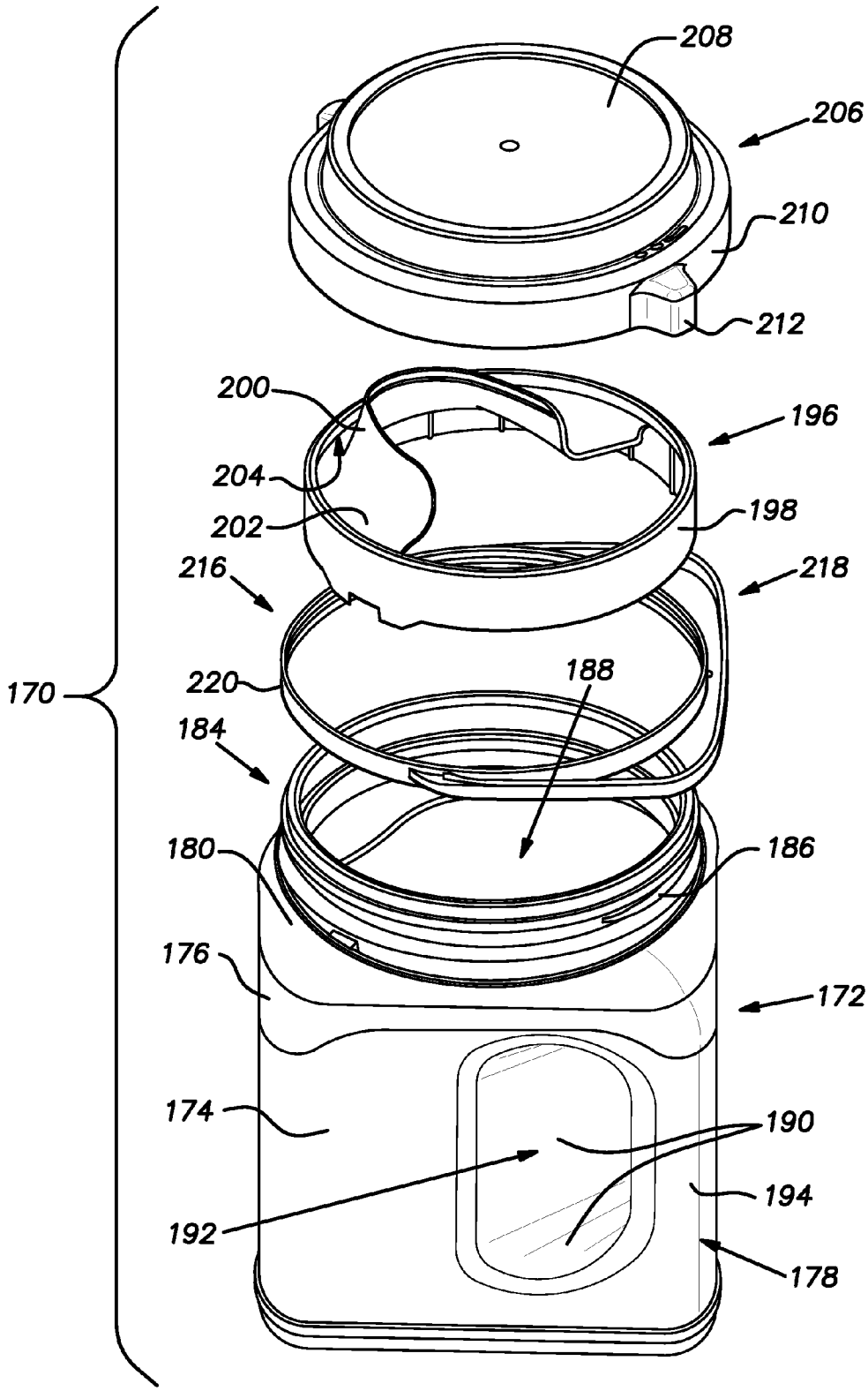
FIG. 8 shows an exploded view of a generally square paint container.

In the first embodiment, the bucket 70 is adapted for holding a conventional one gallon paint container, as well as a generally square paint container having an integral handle and a width of about 6 10/16 inches. An example of such a square paint container is shown in FIG. 8. The paint container 170 comprises a plastic body 172 defining an interior volume for holding a fluid dispersion, such as architectural paint. The body 172 is preferably blow molded from high density polyethylene and has a generally square shape with four generally square side walls, including a first handle side wall 174 and a second handle side wall (not shown). The side walls are joined at two rounded side corners 176, a handle corner 178 and a sloping front corner (not shown), which is disposed opposite to the handle corner 178. The body 172 also includes a bottom wall (not shown) and a top wall 180 with an enlarged opening formed therein. A collar 184 with an external thread 186 is disposed around the opening in the top wall 180 and extends upwardly therefrom. The collar 184 terminates in an upper rim 184*a* defining an access opening 188, which is sized to permit a conventional paint brush to extend therethrough. More specifically, the access opening 188 preferably has a diameter greater than about 4 inches, more preferably greater than about 5 inches.

The body 172 has a plurality of inner walls 190 defining a handle passage 192 that extends through the first handle side wall 174 and the second handle side wall. The first handle side wall 174 and the second handle side wall are joined at the handle corner 178. The first handle side wall 174 is joined to the bottom wall at a rounded bottom edge. A handle 194 is formed at the handle corner 178 of the body 172 and extends vertically across the handle passage 192. An innermost one of the inner walls 190 that defines the handle passage 192 is disposed laterally inward from the collar 184. In this manner, a portion of the handle passage 192 is disposed laterally inward from the collar 184. The handle passage 192 and the handle 194 are integrally formed with the rest of the body 172 during the blow molding of the body 172. Thus, the handle 194 is an integral handle formed in the body 172 of the paint container 170.

The formation of the handle 194 reduces the interior volume of the body 172 in the vicinity of the handle corner 178 and thus, the amount of paint disposed in the vicinity of the handle corner 178 when the paint container 170 is filled with paint. In other words, the formation of the handle 194 displaces a certain amount of paint from the vicinity of the handle corner 178. The weight of this displaced paint shifts the center of mass of the filled paint container 170 toward the front corner.

A pouring insert 196 is provided for removable mounting in the access opening 188 of the paint container 170. The pouring insert 196 comprises an annular mounting ring 198 having a skirt for disposal over the upper rim 150*a* of the paint container 170. A pour spout 200 is disposed radially inward from the mounting ring 198 and is joined thereto by a curved wall 202. The pour spout 200 is arcuate and extends above the upper rim 184*a*. The apex of the pour spout 200 is spaced about ½ an inch from the upper rim 184*a* when the pouring insert 196 is properly disposed in the access opening 188. The curved wall 202 slopes downwardly as it extends rearwardly, toward the handle 194. The curved wall 202, the mounting ring 198 and the pour spout 200 define a drainage groove 204 that collects paint drips from the pour spout 200 and permits the collected paint to flow back into the paint container 170.

A tiered lid 206 is provided for closing the access opening 188. The lid 206 comprises a cylindrical top portion 208 joined to a larger cylindrical bottom portion 210. A pair of grip lugs 212 extend radially outward from an outside surface of the bottom portion 210. The bottom portion 210 has an internal thread (not shown) for engaging the thread 186 of the collar 184 to threadably secure the lid 206 to the collar 184. The external thread 186 of the collar 184 and the internal thread of the lid 206 are configured such that rotation of the lid 206 in a clock-wise direction tightens the lid 206 to the collar 184 and conversely, rotation of the lid 206 in a counter clockwise direction loosens the lid 206 from the collar 184.

The width of the paint container 170 is substantially the same as the diameter of a conventional one gallon paint container, namely about 6 10/16 inches. The height of the paint container 170, up to the top of the lid 206 (when it is securely threaded to the collar 184) is about 8 inches. The interior volume of the paint container 170 is slightly greater than 1 U.S. gallon.

The paint container 170 includes a bail handle structure 216 composed of plastic and comprising a bail handle 218 integrally joined at opposing ends to an annular band 220. The bail handle 218 is generally rectangular and has two legs joined to opposing ends of a central member so as to be generally perpendicular thereto. Preferably, the band 220 is constructed to be expandable so that the band 220 can be snapped over the collar 184 and trapped under a lowermost turn of the thread 186. The band 220 can be rotated around the collar 184 between a flush position, wherein the legs and central member are substantially parallel to and flush with the side walls of the body 172, and an extended position, wherein the legs and the central member are disposed at oblique angles to the side walls, thereby forming protruding loops. The bail handle 218 can be flexed to a carrying position, wherein the bail handle 218 is substantially perpendicular to the band 220.

In the following description of the positioning of the paint container 170 in the bucket 70 and the subsequent operation of the mixing apparatus 10, the paint container 170 will be considered to be filled with an architectural paint.

The paint container 170 may be disposed in the bucket 70 by holding the paint container 170 (through the bail handle 218 or otherwise) over the holding space 122 such that the handle corner 178 is aligned with the corner 120*a*. The paint container 170 is then moved downwardly so as to enter the holding space 122. As the paint container 170 moves downward, the bottom edge of the paint container 170 along the first handle side wall 174 contacts the outer surface 162 of the first head 154 of the rocker 146 and pushes it outwardly, which causes the rocker 146 to pivot from the first position to the second position. The outward movement of the first head 154 permits the bottom edge of the paint container 170 to pass below the opening 140*a* and continue its downward movement. As the paint container 170 continues to move downward, the bottom edge of the paint container 170 contacts the inner surface 164 of the second head 156 of the rocker 146 and pushes it outwardly, which causes the rocker 146 to pivot back to the first position. When the rocker 146 moves back to the first position, the first head 154 moves into the handle passage 192 of the paint container 170. The movement of the first head 154 into the handle passage 192 permits the second head 156 to move outwardly enough to enable the bottom edge of the paint container 170 to clear the second head 156 and pass below the opening 140*b*. The paint container 170 continues to move downward (with the first head 154 of the rocker 146 disposed in the handle passage 192) until the bottom wall of the paint container 170 contacts the flanges 88 of the base 74. At this point, the paint container 170 is fully disposed in the bucket 70.

Once the paint container 170 is fully disposed in the bucket 70, the levers 136 of the clamping structures 128 are manipulated by an operator to place the clamping structures 128 in the clamping positions, wherein the levers 136 are disposed over the bottom portion 210 of the lid 206 of the paint container 170. In this manner, the paint container 170 is trapped between the flanges 88 and the levers 136, thereby securing the paint container 170 in the bucket 70.

With the paint container 170 positioned in the bucket 70 as described above, the paint container 170 is supported on the flanges 88 and is spaced above the floor plate 76. In addition, the vertical axis of the paint container 170 is aligned with the axial opening in the base 74. Thus, the vertical axis of the paint container 170 is disposed coaxially with the axis B-B. Since the paint container 170 is disposed coaxially with the axis B-B and since the center of mass of the paint container 170 is disposed toward the front corner of the paint container 170 (due to the paint displaced by the formation of the handle 194), the center of mass of the paint container 170 is offset from the axis B-B and is disposed toward the corner 120*c*. The weight of the weight bar 168 (and the holding guide 142), however, are specifically selected to counterbalance this offset in the center of mass of the paint container 170. More specifically, the weight of the weight bar 168 (and the holding guide 142) are selected such that the combination of the bucket 70 and the paint container 170 has a center of mass aligned with the axis B-B. In this manner, when the paint container 170 is being shaken by the mixing apparatus 10 and is being rotated about the axis B-B, the combination of the bucket 70 and the paint container 170 is balanced with respect to the axis B-B, thereby avoiding excess shaking and rocking of the mixing apparatus 10.

In addition to providing weight to help balance the combination of the bucket 70 and the paint container 170, the holding guide 142 also helps ensure that the paint container 170 is properly positioned in the bucket 70, i.e., positioned such that the handle corner 178 is disposed in the corner 120*a*. If the handle corner 178 of the paint container 170 is not aligned with the corner 120*a* of the bucket 70 when the paint container 170 is being inserted into the bucket 70, the first head 154 of the rocker 146 cannot move into the handle passage 192 when the second head 156 is contacted by the bottom edge of the paint container 170. This inability of the first head 154 to move into the handle passage 192 prevents the second head 156 from moving sufficiently outward to enable the bottom edge of the paint container 170 to clear the second head 156 and pass below the opening 140*b*. As a result, the second head 156 blocks further downward movement of the paint container 170, thereby providing an indication that the paint container 170 is positioned incorrectly.

Figure 10:
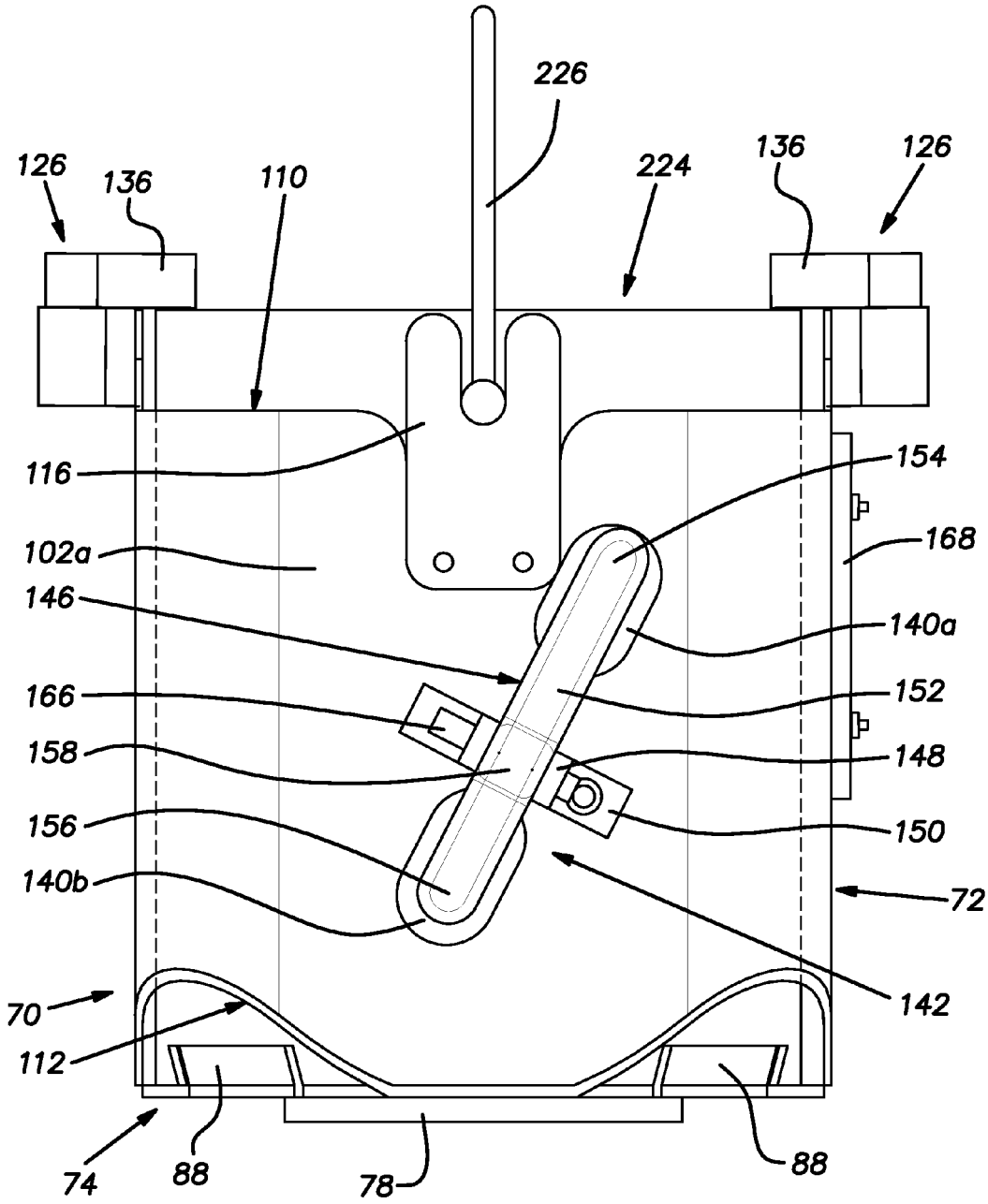
FIG. 10 shows a side elevational view of a conventional one gallon paint container disposed in the bucket of the mixing apparatus.
Figure 11:
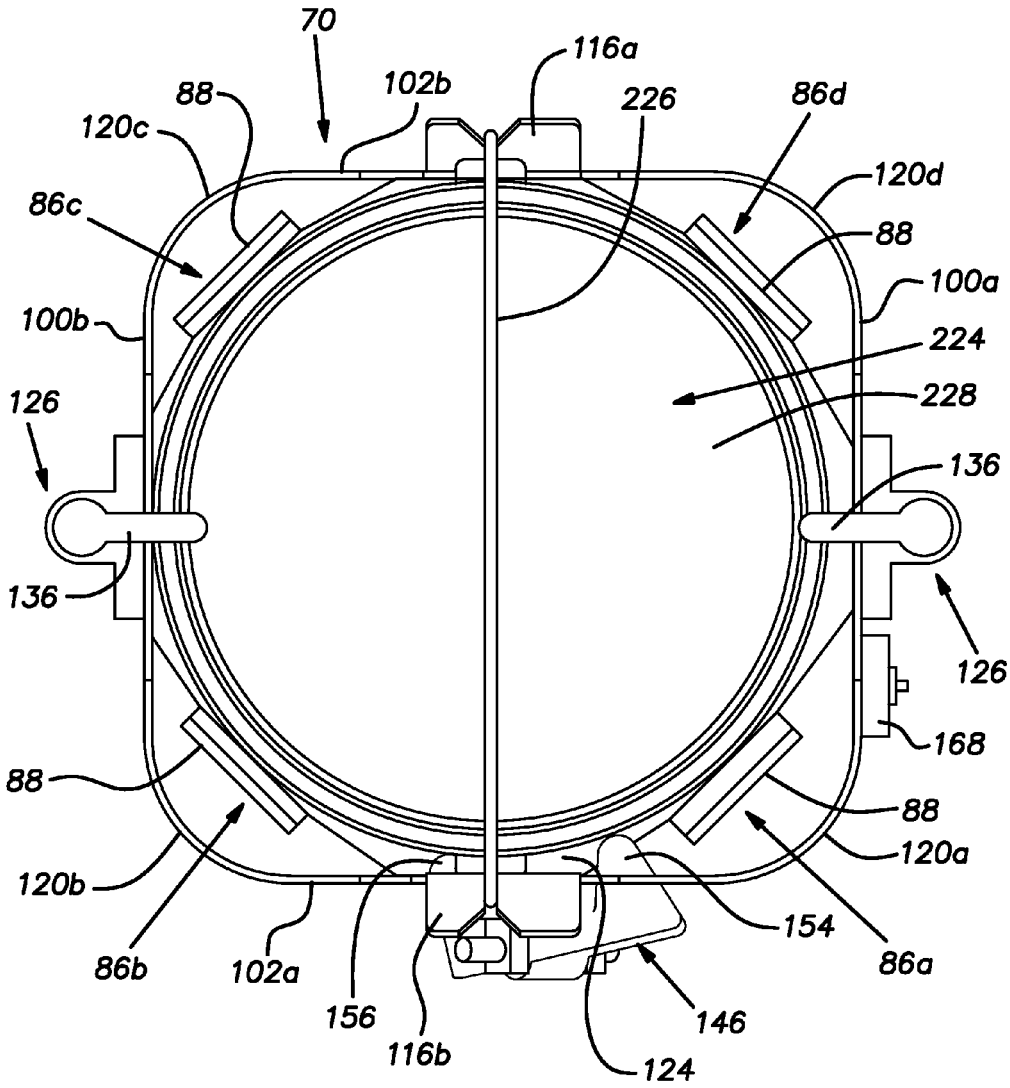
FIG. 11 shows a top view of the conventional one gallon paint container disposed in the bucket of the mixing apparatus.

In addition to holding the paint container 170, the bucket 70 is adapted for holding a conventional one gallon paint container, such as a conventional container 224 filled with an architectural paint that is partially shown in FIGS. 10 and 11. The conventional container 224 may be disposed in the bucket 70 by holding the conventional container 224 (through its bail handle 226 or otherwise) over the holding space 122 such that the conventional container 224 is aligned with the cylinder-receiving region 92 of the floor plate 76 of the base 74 and the mounting ears of the conventional container 224 are aligned with the spring clips 116*a,b*. The conventional container 224 is then moved downwardly so as to enter the holding space 122. As the conventional container 224 moves downward, a bottom edge of the conventional container 224 contacts the outer surface 162 of the first head 154 of the rocker 146 and pushes it outwardly, which causes the rocker 146 to pivot from the first position toward the second position. The outward movement of the first head 154 permits the bottom edge of the conventional container 224 to pass below the opening 140*a* and continue its downward movement. As the conventional container 224 continues to move downward, the bottom edge of the conventional container 224 contacts the inner surface 164 of the second head 156 of the rocker 146 and pushes it outwardly, which causes the rocker 146 to pivot back toward the first position. Since the conventional container 224 does not have a handle passage, the first head 154 contacts the conventional container 224 before the first head reaches the first position, thereby halting the inward movement of the first head 154 of the rocker 146. At this point, the rocker 146 is in the third position and both the first and second heads 154, 156 are in contact with or close proximity to the conventional container 224. Since the cylinder receiving region 92 is offset toward the second wall 102*b* (as described above), the conventional container 224 is spaced by the gap 124 from the second wall 102*a*. The gap 124 accommodates the first and second heads 154, 156 of the rocker 146 and permits the conventional container 224 to move past the first and second heads 154, 156 of the rocker 146 and continue to move downward until a bottom end wall of the conventional container 224 contacts the floor plate 76 within the cylinder receiving region 92. At this point, the conventional container 224 is fully disposed in the bucket 70.

With the conventional container 224 positioned in the bucket 70 as described above, the conventional container 224 is supported on the floor plate 76 within the cylinder receiving region 92. The first and second heads 154, 156 of the rocker 146 are disposed in the gap 124 and are positioned against or in close proximity to the conventional container 224, thereby preventing an upper portion of the conventional container from moving toward the second wall 102*a* when the bucket 70 is rotating. In this manner, the holding guide 142 helps to hold a conventional one gallon paint container in the bucket 70 during the operation of the mixing apparatus 10.

Since, the conventional container 224 is disposed in the cylinder receiving region 92, the vertical axis of the conventional container 224 is offset from the axis of rotation B-B in the direction of the corner 120*c* (and the flanged region 86*c*), i.e., the vertical axis of the conventional container 224 is parallel to, but is spaced from, the axis of rotation B-B. Thus, the center of mass of the conventional container 224 and the paint disposed therein is offset from the axis of rotation B-B, toward the corner 120*c*. The weight of the holding guide 142 and the weight bar at the opposing corner 120*a*, however, counterbalance this offset. In this manner, when the conventional container 224 is being shaken by the mixing apparatus 10 and is being rotated about the axis B-B, the combination of the bucket 70 and the conventional container 224 is balanced with respect to the axis B-B, thereby avoiding excess shaking and rocking of the mixing apparatus 10.

It should be appreciated that the distance the cylinder receiving region 92 is offset toward the flanged region 86*c* (the offset distance) is determined by the weight of the weight bar 168 (and to a lesser extent the holding guide 142), which, in turn, is determined by the weight of paint displaced by the formation of the handle 194 in the paint container 170. More specifically, the weight of the displaced paint in the paint container 170 determines the amount of weight (the offset weight) of a conventional one gallon paint container and the paint contained therein that must be offset toward the flange region 86*c* (and the corner 120*c*). Using a standard density for paint and the weight of a conventional one gallon paint container, the offset distance of the cylinder receiving region 92 is calculated to produce the offset weight.

Once the conventional container 224 is fully disposed in the bucket 70, the levers 136 of the clamping structures 128 are manipulated by an operator to place the clamping structures 128 in the clamping positions, wherein the levers 136 are disposed over a chime lid 228 of the conventional container 224. In this manner, the conventional container 224 is trapped between the floor plate 76 of the base 74 and the levers 136, thereby securing the conventional container 224 in the bucket 70. The mounting ears of the conventional container 224 are held by the spring clips 116*a,b* and lower portions of the bail handle 226 are disposed in the openings 118 of the spring clips 116*a,b*, thereby securing the bail handle 226 from movement when the conventional container 224 is being rotated. Since the conventional container 224 is offset toward the second wall 102*b*, the mounting ear of the conventional container 224 on the side facing the second wall 102*b* fully extends through the slot 114 in the second wall 102*b*, whereas, the mounting ear of the conventional container 224 on the side facing the second wall 102*a* does not extend into the slot 114 in the second wall 102*a* or only does so slightly. The construction of the spring clips 116*a,b*, however, accommodates this offset in the positioning of the mounting ears. More specifically, since the middle portion of the spring clip 116*b* bends inwardly, the middle portion of the spring clip 116*b* is able to contact the mounting ear of the conventional container 224 on the side of the second wall 102*a* within or interior of the slot 114, and since the middle portion of the spring clip 116*a* bends outwardly, the middle portion of the spring clip 116*a* is able to accommodate the mounting ear of the conventional container 224 on the side of the second wall 102*b* and to contact the mounting ear exterior to the slot 114.

Referring back to FIG. 1, the bucket 70 is secured to the mounting support 60 by disposing the bucket 70 on the mounting support 60 such that the mounting shaft 56 extends through the axial opening 94 in the base 74 and the mounting bores 96 are aligned with the bores 64 in the mounting support 60. Bolts (not shown) are inserted through the bores 96 and are threaded into the bores 64. With the bucket 70 secured to the mounting support 60 in the foregoing manner, the bucket 70 extends upwardly, through the circular opening 26 in the cabinet, thereby making the bucket 70 readily accessible to an operator. The central axis of the bucket 70 is collinear with the axis B-B and, thus, preferably intersects axis A-A at an angle of from about 20° to about 40°, more preferably at an angle of about 30°.

The mixing apparatus 10 is especially suited for mixing paint in the paint container 170. Typically, the mixing apparatus 10 is located in a retail store where paint is sold. A paint manufacturer supplies the retail store with the paint container 170 filled with a base paint composition. When a customer selects a particular color for paint, an employee at the retail store determines the required amount of tinting concentrate(s) for producing the selected color. The employee then unscrews the lid 206 from the collar 184 and adds the tinting concentrate(s) to the base paint composition disposed in the body 172 of the paint container 170. The employee then tightly screws the lid 206 back onto the collar 184 and places the paint container 170 in the bucket 70 in the manner described above. With the paint container 170 securely disposed in the bucket 70 as shown in FIG. 1, the employee activates a start switch or button that provides the electric motor 28 with power, which causes the rotor shaft 30 and, thus, the motor sprocket 32 to rotate. The belt 36 transfers the rotation of the motor sprocket 32 to the drive sprocket 34, thereby causing the drive sprocket 34 and, thus, the drive shaft 38 to rotate. The rotation of the drive shaft 38 causes the yoke 44 to rotate about the axis A-A in a counter-clockwise direction which, in turn, causes the drive wheel 58 and the mounting support 60 to rotate about the axis B-B in a counter-clockwise direction. As a result, the bucket 70 and, thus, the paint container 170 are simultaneously rotated about the axis A-A and the axis B-B, thereby mixing the paint in the paint container 170.

It has been observed that when the paint container 170 is rotated about the axes A-A and B-B in a clockwise direction, paint sometimes leaks from the juncture between the lid 206 and the collar 184. Conversely, it has been observed that when the paint container 170 is rotated about the axes A-A and B-B in a counter-clockwise direction, paint does not leak from the juncture between the lid 206 and the collar 184. Without being limited by any particular theory, it is believed that when the paint container 170 is rotating, the movement of the architectural paint disposed in the interior volume of the paint container 170 lags behind the movement of the paint container 170 due to the viscous nature of the paint. As a result, it is believed that the paint creates a force against the lid 206 that is directed opposite to the direction the paint container 170 is rotating. If the paint container 170 is rotating counter-clockwise, it is believed that the force against the lid 206 is directed clockwise, which tends to tighten the lid 206 to the collar 184. If the paint container 170 is rotating clockwise, it is believed that the force against the lid 206 is directed counter-clockwise, which tends to loosen the lid 206 from the collar 184. Accordingly, it is preferred to have the polarity of the electric motor 28 set so as to rotate the yoke 44 about the axis A-A in a counter-clockwise direction, which causes the paint container 170 to rotate about the axis B-B in a counter-clockwise direction.

The mixing apparatus 10 is very effective in mixing fluid dispersions disposed in either a cylindrical container or in a generally square container. In fact, Applicant has found that the mixing apparatus 10 is significantly more effective in mixing a fluid dispersion disposed in a generally square container, such as the paint container 170, than in a cylindrical container, such as a conventional paint container. This result was surprising and unexpected. Without being limited by any particular theory, it is believed that the side walls of the paint container 170 act like paddles to increase agitation of the paint disposed in the interior volume of the paint container 170.

While the invention has been shown and described with respect to particular embodiments thereof, those embodiments are for the purpose of illustration rather than limitation, and other variations and modifications of the specific embodiments herein described will be apparent to those skilled in the art, all within the intended spirit and scope of the invention. Accordingly, the invention is not to be limited in scope and effect to the specific embodiments herein described, nor in any other way that is inconsistent with the extent to which the progress in the art has been advanced by the invention.

What is claimed is:

1. The method of mixing paint, said method comprising the steps of:

(a.) providing a cylindrical container filled with a first paint (b.) disposing the cylindrical container between at least one pair of opposing walls;

(c.) rotating the at least one pair of opposing walls and the cylindrical container about an axis that is parallel to and spaced from the vertical axis of the cylindrical container; and (d.) removing the cylindrical container from between the at least one pair of opposing walls;

(e.) providing a second container filled with a second paint, said second container having a body with a substantially rectangular cross-section;

(f.) disposing the second container between the least one pair of opposing walls;

(g.) rotating the at least one pair of opposing walls and the second container about an axis that is collinear with the vertical axis of the second container; and (h.) removing the second container from between the at least one pair of opposing walls.

2. The method of claim 1, wherein the body of the second container comprises a plurality of side walls joined at rounded corners so as to provide the body with a substantially square cross-section, wherein a first one and a second one of the side walls of the second container form a first one of the corners, and wherein a handle passage extends through the first one and the second one of the side walls to form a handle at the first one of the corners.

3. The method of claim 2, further comprising inserting a first head of a rocker in the handle passage of the second container before the second container is rotated.

4. The method of claim 3, further comprising placing the first head of the rocker and a second head of the rocker against the cylindrical container before the cylindrical container is rotated.

* * * * *